US005863639A

United States Patent [19]

Franke et al.

[11] Patent Number: 5,863,639

[45] Date of Patent: Jan. 26, 1999

[54] NONWOVEN SHEET PRODUCTS MADE FROM PLEXIFILAMENTARY FILM FIBRIL WEBS

[75] Inventors: Ralph A. Franke, Richmond; Hyun S. Lim; Larry Ray Marshall, both of Chesterfield, all of Va.; Michael P. Milone, Elmer, N.J.; R. Gail Raty, Wilmington; Akhileswar G. Vaidyanathan, Hockessin, both of Del.

[73] Assignee: E. I. du Pont de Nemours and Company, Wilmington, Del.

[21] Appl. No.: 685,367

[22] Filed: Jul. 23, 1996

Related U.S. Application Data

[60] Provisional application No. 60/003,723 Sep. 13, 1995.

[51] Int. Cl.[6] ..... B32B 27/14

[52] U.S. Cl. ..... 428/198; 73/159; 324/71.1; 356/431; 428/212; 428/218; 428/219; 428/311.5; 428/315.5; 428/903; 442/334

[58] Field of Search ..... 442/334; 428/198, 428/212, 218, 219, 311.5, 315.5, 903

[56] References Cited

U.S. PATENT DOCUMENTS

| | | | |
|---|---|---|---|
| 3,081,519 | 3/1963 | Blades et al. | 28/81 |
| 3,169,899 | 2/1965 | Steuber . | |
| 3,227,784 | 1/1966 | Blades et al. | 264/53 |
| 3,227,794 | 1/1966 | Anderson et al. | 264/205 |
| 3,851,023 | 11/1974 | Brethauer et al. | 264/24 |
| 5,123,983 | 6/1992 | Marshall | 156/167 |

*Primary Examiner*—James J. Bell

[57] ABSTRACT

This invention relates to improved sheet products and specifically to improved nonwoven sheet products made from highly oriented plexifilamentary film-fibril webs. The improved sheet products have high opacity and strength with a much wider range of porosity or Gurley Hill Porosity Values. In particular, sheet products made in accordance with the present invention have considerably higher Gurley Hill Porosity Values than similar weight sheet products subject to the same finishing treatments in accordance with prior known sheet materials. Similarly, sheet products made in accordance with the present invention can be made which have much lower Gurley Hill Porosity Values than prior sheet materials. The invention includes numerous methods and data characterizing the webs and sheets that form the improved sheet materials.

20 Claims, 3 Drawing Sheets

NONWOVEN SHEET PRODUCTS MADE FROM PLEXIFILAMENTARY FILM FIBRIL WEBS

This application claims the benefit of U.S. Provisional Application No. 60/003,723, filed Sept. 13, 1995.

FIELD OF THE INVENTION

This application relates to sheets made from man-made polymer fibers and particularly to nonwoven sheets made from flash spun plexifilamentary film-fibril webs.

BACKGROUND OF THE INVENTION

E. I. du Pont de Nemours and Company (DuPont) has been in the business of making Tyvek® spun bonded olefin sheet product for many years. However, the commercial process for making Tyvek® includes the use of a CFC (chlorofluorocarbon) spin agent. As the use of CFC's will soon be prohibited, DuPont has been developing a non-CFC process for manufacturing Tyvek® sheet. Unfortunately, there is, as yet, no identified spin agent that may be used as a simple substitute in place of the present CFC spin agent without requiring substantial modifications of the process or process conditions for manufacturing the product.

Thus, an entirely new facility has been built to manufacture Tyvek® sheet using a substantially modified process and a very different spin agent. The new spin agent is a hydrocarbon, namely: normal pentane, and just about every process activity and condition has been changed or scrutinized because the new spin agent does not act or react exactly like the CFC spin agent in the present commercial system. It is of course, the intent of all the developmental work to be able to produce essentially the same sheet product as made in the conventional commercial process so as to continue to develop the business and markets that the Tyvek® business has created.

The developmental work for recreating the process of making Tyvek® sheet has the additional object to form improved products that have better characteristics for current and new end uses.

It is a particular object of the present invention to provide sheet products that have a wider range of Gurley Hill Porosity Values than that which is attainable by conventional nonwoven technology.

SUMMARY OF THE INVENTION

The invention is directed to a number of related sheet products made with polymeric man-made fiber that may be characterized in a number of independent ways. For example, one sheet has and opacity of at least 80 percent and a Gurley Hill Porosity Value of at least 120 seconds. Preferably this sheet product has a basis weight of less than 2.5 oz/sq yd and more preferably a basis weight of less than 1.7 oz/sq yd. Another sheet has a basis weight of at least 1.4 oz/sq yd and a Gurley Hill Porosity of less than 20 seconds. Another sheet has less than forty percent voids in the cross sectional area wherein no more than five percent have extremum lengths greater than 27 microns. A further sheet has at least thirty percent voids and at least five percent of the voids have extremum lengths greater than 23 microns.

A still further sheet is fully bonded and has a Correlation relative to spatial period wherein the correlation is in the range of 0.4 to 0.8 at a 15 pixel spatial period, 0.45 to 0.85 at a ten pixel spacing period, and 0.3 to 0.8 at a 20 pixel spatial period, wherein the measurements are based on a Hewlett Packard Deskscan II scanner operating under standard conditions and the pixels are approximately 169 microns square. Another sheet is similarly characterized but having a correlation of 0.1 to 0.5 at a 15 pixel spatial period, 0.15 to 0.55 at a ten pixel spatial period and a 0.05 to 0.45 correlation at a 20 pixel spatial period wherein the same equipment is used under normal conditions and the pixel size is the same.

A still further characterized sheet is set forth which is fully bonded and has a Haralick feature 13 Information Measure of Correlation between 0.19 and 0.35 at a ten pixel spatial period, between 0.15 and 0.325 at a 15 pixel spatial period, and between 0.125 and 0.3 at a 19 pixel spatial period wherein the pixels are approximately 169 square microns. A different sheet is similarly characterized and set forth having a Haralick feature 13 Information Measure of Correlation in the range of 0.075 to 0.2 at a ten pixel spatial period, 0.05 and 0.175 at a 15 pixel spatial period, and between 0.05 and 0.175 at a 19 pixel spatial period.

The invention further relates to a sheet being defined as a nonwoven sheet product made of overlapping layers of flash spun fibers bonded together with at least heat and pressure, wherein the web comprises fibrils having a mean apparent fiber width of greater than 24 microns, a median apparent fiber width of greater than about 13.5 microns and wherein the fibers are spun from one or more orifices at less than 100 pounds per hour per orifice, and wherein the sheet product has a Gurley Hill Porosity Value of greater than 30 seconds. An additional nonwoven sheet product is set forth which is made of overlapping layers of flashspun fibers bonded together with at least heat and pressure, wherein the web comprises fibrils having a mean apparent fiber width of less than 25 microns, a median apparent fiber width of less than about 13.5 microns, such that the fibers are spun from one or more orifices at less than 100 pounds per hour per orifice, and wherein the sheet product has a Gurley Hill Porosity Value of less than 20 seconds. A further nonwoven sheet product is set forth which is made of a plurality of overlapping plexifilamentary film-fibril webs wherein the webs have openings between the fibrils and the openings have an average perimeter of at least 2650 microns, the sheet includes portions which have at least four separate overlapping web swaths and the Gurley Hill Porosity Value is at least 25 seconds. Another nonwoven sheet product is set forth which is made of a plurality of overlapping plexifilamentary film-fibril webs wherein the webs have openings between the fibrils and the openings have an average perimeter of less than 3300 microns, the sheet includes portions which have at least four separate overlapping web swaths and the Gurley Hill Porosity Value is less than 75 seconds.

The invention is further related to a nonwoven sheet product made from a plurality of overlapping plexifilamentary film-fibril webs, wherein the sheet product has a cross section comprising fibrils which are bonded together and form voids within the sheet, the voids forming less than forty percent (40%) of the cross sectional area of the sheet and wherein the voids have a general shape so as to appear long and thin and wherein no more than five percent of the voids have extremum lengths greater than 27 microns.

Preferably, the nonwoven sheet product has an opacity of greater than 80. More preferably, the nonwoven sheet product according to claim 18 wherein the Gurley Hill Porosity Value is greater than 80. In addition, it is preferred that the nonwoven sheet product has less than fifteen percent of the voids having extremums greater than four microns.

The invention also relates to a method of characterizing a plexifilamentary film-fibril web comprising a number of steps, in particular, the first step is scanning a sample of the plexifilamentary film-fibril web with optical scanning equipment to create an image of the scanned sample and the next step is to digitize the image of the scanned sample. Thereafter, the openings between fibrils in the digitized image are identified and the perimeters of the openings between the fibrils to are measured to create a data set for comparison to other web samples.

The invention further relates to another method of characterizing a plexifilamentary film-fibril web comprising scanning a sample of the plexifilamentary film-fibril web with optical scanning equipment to create an image of the scanned sample and digitizing the image of the scanned sample. Thereafter, the individual fibrils in the digitized image are identified and the width of the fibrils are measured to create a data set for comparison to other web samples.

Finally, the invention relates to an additional method of characterizing a sheet material comprising the steps of cutting a sample of the sheet material to reveal a cross section thereof, scanning the cross section of the sample of the sheet material with a scanning electron microscope to create an image of the scanned sample and digitizing the image of the scanned sample. Thereafter, the voids in the cross section in the digitized image are identified and the voids are measured to create a data set for comparison to other sheet samples.

BRIEF DESCRIPTION OF THE DRAWINGS

The invention will be more easily understood by a detailed explanation of the invention including drawings of pertinent aspects thereof. Accordingly, such drawings are attached herewith and are briefly described as follows.

DETAILED DESCRIPTION OF THE PREFERRED EMBODIMENT

As described above, the commercial process for manufacturing Tyvek® sheet includes the use of a CFC spin agent. By conventional process, the spin agent and polymer, polyethylene, are mixed under heat and pressure until the two materials form a single phase solution. The single phase solution comprises about 88% (by weight) CFC spin agent, Freon®-11 (trichlorofluoromethane) and the remaining 12% (by weight) polymer. It should be noted that some additives may be used such as UV stabilizers, spiking agents and other materials which are typically used at portions of less than 2%, and preferably much less than 2%. Such additives have little effect on the dissolution strength of the spin agent or the process conditions of spinning. Examples of such additives are for UV stabilization (to prevent Ultraviolet degradation of Tyvek® sheet from exposure to sunlight) and perhaps enhanced electrostatic performance as described in U.S. patent application Ser. No. 08/367,367.

Figure 1:
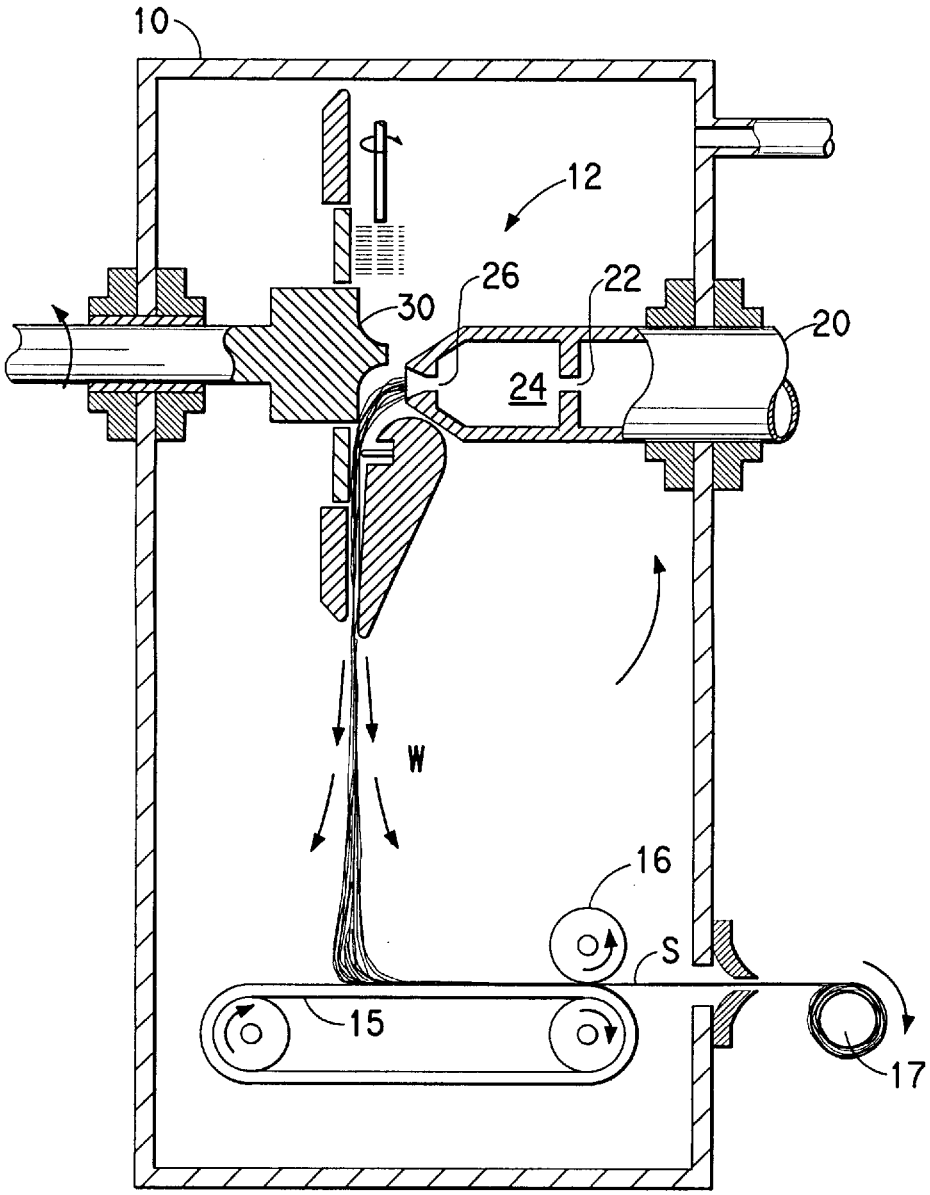
FIG. 1 is a generally schematic cross sectional horizontal elevational view of a single spin pack within a spin cell illustrating the formation a sheet product.

In the present system, the polymer is mixed with the spin agent to form a single phase solution at high pressure and temperature. The process is fairly completely described in other DuPont owned patents such as U.S. Pat. Nos. 3,081,519 to Blades et al., 3,227,784 to Blades et al., 3,169,899 to Steuber, 3,227,794 to Anderson et al., 3,851,023 to Brethauer et al., 5,123,983 to Marshall, and U.S. patent application Ser. No. 08/367,367. all of which are hereby incorporated herein by reference. Once the polymer and spin agent form a single phase solution, the solution is directed to a spin cell, such as generally illustrated by the number 10 in FIG. 1, in which a fiber web W is flash spun and formed into a sheet S. The illustration of the spin cell 10 is quite schematic and fragmentary for purposes of explanation. A schematically illustrated spin pack, generally indicated by the number 12, is positioned within the spin cell 10 in the process of spinning the fiber web W. It should be understood that the process of manufacturing Tyvek® sheet material includes the use of a number of additional spin packs similar to spin pack 12 which are arranged in the spin cell 10 spinning and laying down other webs W to be overlapped together. As is described in the above and other disclosures, the web is comprised of a number of fibrils connected together in a web like network. Each of the fibrils is a thread like portion extending from one tie point to another. The fibrils do not have a round cross section but rather have a flattened and very irregular shape like crinkled film and having a lot of surface area.

The spin pack 12 spins the web from a polymer solution which is provided to the spin pack 12 through a conduit 20. The polymer solution is provided at high temperature and pressure so as to be a single phase solution. The polymer solution is then admitted through a letdown orifice 22 into a letdown chamber 24. There is a pressure drop through the letdown orifice 22 so that the solution experiences a slightly lower pressure. At this lower pressure, the single phase solution becomes a two phase solution. A first phase of the two phase solution has a relatively higher concentration of polymer as compared to the polymer concentration of the second phase which has a relatively lower concentration of polymer. The system operates such that the percentage of polymer in the solution is between slightly less than ten percent up to in excess of twenty five percent based on weight and depending on the spin agent. Thus, the polymer rich phase probably still has more spin agent than polymer on a comparative weight basis. Based on observations, the polymer rich phase appears to be the continuous phase.

From the letdown chamber 24, the two phase polymer solution exits through a spin orifice 26 and enters the spin cell 10 which is at much lower temperature and pressure. At such a low pressure and temperature, the spin agent evaporates or flashes from the polymer such that the polymer is immediately formed into a plexifilamentary film-fibril web. The web W exits the spin orifice 26 at very high velocity and is flattened by impacting a baffle 30. The baffle 30 further redirects the flattened web along a path that is roughly 90 degrees relative to the axis of the spin orifice (generally downwardly in the drawing). The baffle 30, as described in other DuPont patents such as those noted above, rotates at high speed and has a surface contour to cause the web W to oscillate in a back and forth motion in the widthwise direction of the conveyor belt 15.

It would be ideal if each web W would form a generally sinusoidal patterned swath, broadly covering the belt; however, in actual practice, there is a substantial randomness to the pattern in which the web becomes arranged on the conveyor belt 15. There are many dynamic forces on the web, in addition to the turbulence in the spin cell, that effectively cause the webs to "dance" on the conveyor belt.

Figure 2:
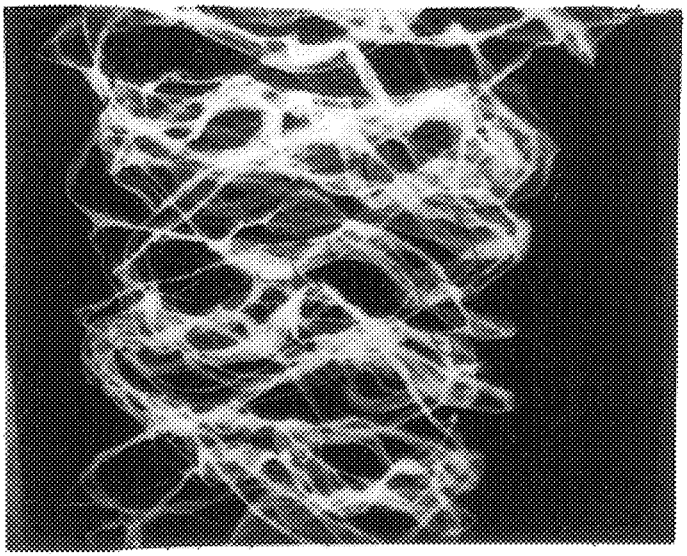
FIG. 2 is a top view photographic image of a single web swath as laid down by a single spin pack onto a moving conveyor belt.

In addition, the webs tend to collapse, at times, from a spread apart "spider web" like netting of approximately 1 to 8 or more inches in width, into a yarn like strand of less than an inch. Thus, there are portions in the pattern that are broadly opened up generously covering the belt, while other portions cover only a thin strip of the conveyor belt. As seen in FIG. 2, the swath formed by a single web includes many holes or portions which are not filled in. The example in FIG. 2 was run at 300 yards per minute which is near the upper portion of the preferred speed range. The range is broadly, from about 25 to about 500 or more yards per minute with the preferred range being rather broad (roughly about 50 to about 400 Yards per minute) because of the many considerations for belt speed. From FIG. 2, it should be clear that the lay down includes some overlay of the web swath onto itself with some open portions distributed throughout the swath. However, at slower belt speeds, the swath is better filled in and has a higher basis weight from the particular web swath.

As noted above, the sheet material is formed from the webs of a number of spin packs. Thus, the web swaths overlap web swaths of numerous other spin packs, depending on the speed of the web impacting the baffle 30 and the rotation speed of the baffle. The rotation speed of the baffle 30 preferably results in a complete oscillation of the web being formed at the rate of generally between 60 to 150 cycles per second and the web swaths end up being about one to three feet wide. The spin packs are preferably arranged in a staggered configuration along the conveyor direction (or machine direction) so that each spin pack may be laterally offset (widthwise to the belt) in the range of less than an inch up to about five inches from the next closest spin pack. Clearly, the sheet product S will be formed of many overlapping web swaths.

At the end of the spin cell 10, the sheet product S has the form of a batt of fibers very loosely attached together. The batt is run under a nip roller 16 to consolidate it into the sheet product S and it is then wound up on roll 17. The sheet product S is then taken to a finishing facility where it may be subjected to an assortment of processes depending on the end use of the material. Most Tyvek® sheet end uses are for fully bonded or surface bonded sheet goods. Most people come into contact with fully bonded Tyvek® sheet with envelopes and housewrap. Fully bonded sheet is formed from the sheet product S by pressing it on heated rolls which have relatively smooth surfaces to contact substantially the entire sheet surface. The heat is maintained at a predetermined temperature (depending on the desired characteristics of the final sheet product) such that the webs bond together under the pressure to form a sheet that has substantial strength and toughness while maintaining its opaque quality. For example, Tyvek® sheet is noted for its tear strength and tensile strength. DuPont also measures delamination strength, burst strength, hydrostatic head, breaking strength, and elongation of its many styles of Tyvek® sheet. Unfortunately, in order to obtain certain qualities other attributes tend to be compromised. For example, delamination strength is improved by higher bonding temperatures so that the middle portion of the sheet becomes fully heated and therefore, more completely bonded to the surface regions of the sheet. However, heat tends to shrink the highly oriented molecular structure of the fibrils and the surface area of the fibrils is reduced. Lower surface area reduces the opacity and the Tyvek® sheet becomes more translucent.

As noted above, there are many characteristics of Tyvek® sheet that DuPont investigates, monitors and is otherwise interested in continually optimizing for various end use requirements and purposes. For example, the barrier properties of fully bonded sheet are important in many applications, so porosity is measured by the Gurley Hill method.

With experiments run in anticipation of making Tyvek® sheet material with a new spin agent, Gurley Hill Porosity Values for initial sheet products were found to be below that which is normally attained with the CFC spin agent. This is desirable for certain end uses such as wearing apparel, and in fact is an improved material for Tyvek® apparel end uses. However, there are other end uses, such as for construction housewrap, for which much higher Gurley Hill Porosity Values are desirable and, perhaps, commercially necessary. Thus, although this is a break through for low Gurley Hill Porosity Values for certain end uses, it has been necessary to seek appropriate changes in the process so as to, at times, create sheet products having high Gurley Hill Porosity Values to meet market demands for high barrier materials.

In many years of experience with the CFC spin agent and the recent intensive investigation related to the commercialization of a new spin agent, DuPont engineers have noted that when the webs formed in the spinning process are very fine and having lots of fibrils, the Gurley Hill Porosity Values tend to be higher (meaning that the sheet is less porous). This is consistent with nonwoven sheets made using other technologies such as, for example, nonwoven sheets made from meltspun and meltblown fibers. In addition, Darcy's law provides scientific prediction of the porosity of fabrics based on the diameter of the fibers in the fabric. Darcy's law is very complicated and would be difficult to explain in this patent, but suffice it to say that Darcy's law also predicts that the smaller the fibers, the smaller the pores and the less porous the sheet. Thus, the porosity decreases with finer fiber size as one would expect.

Referring back again to the original tests with the new spin agent, the fibril sizes of the webs were actually quite comparable to the fibril sizes of the webs normally attained with the CFC system. Thus, it was believed that it would take a rather well fibrillated web (comprising many, many fibrils of finer size and short length) to attain a satisfactorily high Gurley Hill Porosity Value. Numbers of tests were run testing a great array of possible conditions for the system. Other tests were run changing parameters which were previously unexplored.

One of the modified conditions was the length of the letdown chamber. It was found that if the length of the letdown chamber were reduced while maintaining its standard diameter, a web having what appears to be fewer and larger fibrils was produced. The webs included portions which may be characterized as "bunched fibrils". The bunched fibrils at times appeared to be a single, large fibril and at other times appeared to be comprised of small fibrils with extremely short tie points preventing the bunched fibrils from being opened up by hand to reveal any type of verifiable fibrillation or characterization. In accordance to conventional wisdom within the company, such webs would have been expected to have even lower Gurley Hill Porosity Values than was produced in the original configuration. Little attention was initially given to such poor appearing webs; however, for completeness, the poorly fibrillated webs were bonded for comparative testing.

Surprisingly, it was found that the Gurley Hill Porosity Value of the sheet made from the poorly fibrillated webs was considerably higher than that from the original sheets having fibril size comparable to the CFC system. Upon this discovery, further tests and experiments have been run to better understand the unexpected phenomenon and more importantly to obtain optimum sheets products for manufacture and sale from the new process.

Other factors were found to alter the Gurley Hill Porosity Value of the bonded sheets. For example, it has been found that sheet products having the same basis weight but which are comprised of a different number of layers of fiber is likely to have different porosity. The effects of the numbers of layers was not appreciated until experiments were run to ascertain the cumulative effects of the layers of webs. For this discussion, it is important that a number of terms be clearly understood. The term "web" is used and intended to mean a continuous strand of a flash spun plexifilament emanating from a single spin orifice or hole. The term "swath" or "web swath" is intended to mean the web in an arrangement such as formed when the web has been laid onto a moving conveyor belt or similar device in a back and forth pattern widthwise relative to the conveyor belt. A "sweep" of a web is a portion of the web swath that extends generally from one extreme of the back and forth pattern to the other side. A "return sweep" is a sweep that extends back across the web swath in the opposite direction. Thus, it takes two "sweeps" to form a complete cycle of the oscillating pattern of the web swath.

Continuing with the construction of the sheet, it must be understood that the thickness of the sheet is formed by numerous individual sweeps, some of which are successive sweeps from the same web and others which are from successive or preceding webs. To form a sheet product of a predetermined basis weight (weight per area of fabric), the rate of fiber production from each spin pack is maintained relatively constant and the conveyor speed is controlled to bring about the desired basis weight. However, it has been found that if every other spin station is shut down and the conveyor is run at one half the normal belt speed, the sheet is less porous than a sheet which was formed by all packs operating and the conveyor belt moving at full speed. It is believed that the two sheets having the same basis weight have the same number of sweeps forming the thickness of the sheet and the only difference in construction is that one comprising twice as many web swaths as the other. Thus, it is presumed that there must be some interaction between successive sweeps from the same web that is different than the interaction between sweeps of different webs that provides the resulting sheets with different porosity.

Tyvek® sheet material is presently made with the CFC spin agent on three manufacturing lines where two lines have one design while the third uses a design having twice the number of spin packs. Thus, the number of layers in the sheet from the first two manufacturing lines is clearly going to be less than the number of layers in sheet made on the third line. By the knowledge gained in the development of a system to make Tyvek® using a new spin agent, it would seem that the third manufacturing line would make sheet product having much lower Gurley Hill Porosity Values. However, the Gurley Hill Porosity Values turn out to be quite comparable. It seems that the third line operates such that the amount of polymer run through each spin pack is much less and it appears that as a result, the webs have finer fibrillation in the third line. Apparently, the finer fibrillation with the CFC spin agent counteracts the effects of the increased number of layers resulting in approximately the same Gurley Hill Porosity Values.

Several theories have been discussed for the phenomena of lower Gurley Hill Porosity Values being obtained by sheet product having the same basis weight but more web swaths. Presently, the most commonly accepted theory is that the webs have some type of tackiness immediately after it is spun. This tackiness is probably short lived and causes the sweeps from a common swath to adhere or interact in a way that forms a better barrier to gases passing through the web. The tackiness does not last long enough for a web swath from a different spin pack to form the same attachment to the web swaths already on the belt. If there is a tackiness quality immediately after spinning, then the webs are interacting or attaching to one another in a way that a higher Gurley Hill Porosity Value is attained in the bonded sheet. It perhaps should be noted that the Gurley Hill Porosity Value of the sheet product S is highest immediately after it has been formed in the spin cell. When the sheet product is bonded, the fibrils tend to shrink thereby opening up the sheet product and making it more porous. However, the sheet products formed with fewer web swaths (having the same basis weight) maintain higher Gurley Hill Porosity Values after bonding. This phenomena has created complications for running tests in anticipation of large scale commercial manufacturing where the smaller scale test system is designed to manufacture with fewer numbers of web swaths.

As it is desirable for certain end uses to produce less permeable sheet product, then based on the above theory, the system would use fewer spin packs to make sheet products. However, fewer spin packs means lower productivity for the manufacturing system. Thus, to attain certain qualities, productivity must be compromised. It would be desirable to create webs that retain the believed tackiness for a little longer on the conveyor belt so as to obtain higher Gurley Hill Porosity Values while operating at the highest possible productivity.

Returning back to the discussion of the modified letdown chambers described earlier, it has been surmised that the webs produced by such configurations may retain some of the tackiness theorized to benefit Gurley Hill Porosity for a longer period of time. In particular, it is believed that the bunched fibrils may actually hold some of the spin agent therein which causes the web to retain some tackiness for a longer period of time. As such, the dynamics of the solution passing through the letdown chamber may be one key method of obtaining high Gurley Hill Porosity Values. The dynamics are believed to center around the flow through the letdown chamber such that if smooth, continuous flow is established, the webs tend to be well fibrillated but have lower Gurley Hill Porosity. This action is more completely described in Patent Application No. 60/001626 by Franke et al. which is incorporated herein by reference.

As the webs appeared to be made up of larger fibrils than are normally expected to provide suitable sheet product, the fibril size of the webs were quantitatively analyzed. The webs were opened up by hand and imaged using a microscopic lens. The image was digitized and computer analyzed to determine the mean fibril width and standard deviation. This process is based on similar techniques disclosed in U.S. Pat. No. 5,371,810 to A. Ganesh Vaidyanathan dated 6 Dec. 1994 and which is hereby incorporated by reference. It should again be noted that the many of the larger fibrils were actually made up of smaller fibrils but were so tightly bunched together and have such short fibril length, it appeared and acted like a large fibril. Thus, the term "apparent fibril size" is used to describe or characterize the web. Moreover, the tight bunching and short fibril length (distance from tie point to tie point) effectively prevents any analysis on the constitution of the bunched fibrils. The data from this analysis is set forth in Table I at the end of this section.

Another characteristic of the webs which form the sheet which has high Gurley Hill Porosity Values is that the fibrillation of the web is characterized by longer distances between tie points and fewer fibrils. A second analytical technique has been developed to quantify or numerically characterize the web and sheet. A standard Hewlett Packard Scan Jet II CX scanner operating at a resolution of 400 dots (pixels) per inch was used to digitize an image using reflected light of a web swath layer mounted on a black background. Approximately 11.5 inches of web length was digitized with a pixel resolution of 63.5 microns/pixel. The openings between the fibrils form closed contours which were traced using customized image analysis software which effectively identifies the openings between fibrils. From such collected data, the perimeter of each open area is mapped and measured.

The perimeter sizes are relative to the fibril length (length from tie point to tie point) for each web. Thus, webs having longer fibril lengths will have longer perimeter measurements. As it would be extraordinarily difficult and cumbersome to identify each tie point by this method (or for that matter for any computer system to identify the tie points) it was decided that such perimeter measurements would be sufficient for comparison to other webs without having to resort to a careful and tedious analysis of tie point lengths. The acquisition and analysis method described above allows for the rapid quantitation of perimeter length distributions for a large number of samples. The Size Entropy of the openings in the web provides an interesting bit of information about the construction of the web. It is a measure of the uniformity of the size distribution. The number is normalized such that a perfectly uniform distribution would have an entropy of 1 and a perfectly non-uniform distribution would have an entropy of zero. The data from these further measurements and analysis is tabulated in Table II at the end of this section.

Once the sheets were bonded, further analysis was performed on the sheets. Such further analysis is based in part on analytical tools developed by A. Ganesh Vaidyanathan to automatically identify image features in a complex varying background as disclosed and set forth in U.S. Pat. No. 5,436,980 issued on 25 Jul. 1995 which is hereby incorporated by reference. The newly developed techniques characterize void structures within the sheet that seem to have relevance to the porosity of the sheet. The technique comprises cutting a sample of the sheet in a plane extending across the width of the sheet and a plane extending with the length of the sheet. The exposed cross sections of the samples are imaged using a scanning electron microscope (SEM). The SEM images are subsequently digitized using a commercial frame grabber. Void structures across the sheet cross section are identified and traced and several morphological measurements are made. A void is a portion within the cross sectional area of the sheet that is open or devoid of fiber.

It is believed that there are two types of voids. A first type of void is believed to be present within the web swath (which is indiscernible after the sheet is bonded) which tends to be rather small. The second type of void tends to be larger and is believed to be created between web swaths. It is these larger voids that are believed to more strongly influence the porosity of the sheet .

The data are, of course, taken from numerous samples at an 800× magnification in both the cross planes of the sheet and machine direction of the sheet. Although there are some differences in the characteristics in the cross plane versus machine direction, the data has been combined from and equal number of samples in each plane to be representative of the full sheets. A discussion of each of the morphological measurement is discussed below:

Void Fraction—Void Fraction is the percentage of the cross section of the sheet which is comprised of voids. This can be calculated by two methods. The first is by the above described trace method and calculating the percentage of total area. The second is by finding the percentage of pixels that are deemed voids by the analysis software over the total number pixels considered.

Void Extremum—The voids tend to be elongated in the sheet and one measure of relevance is the extreme linear dimension of each void. The extreme linear dimension is the maximum linear distance measurable in a straight line across the void. Voids, as seen in the cross sections, tend to be quite flat while having a substantial linear extent. Thus, while the area of the void may be small, the likelihood of the voids being connected to permit small particles such as gaseous material through the sheet is increased by the extent of the voids in the cross sections. The measurements of the void extremums are provided by mean, median and percentiles. As noted above, the number and size of the larger voids are believed to be quite relevant to the characteristics of the sheet; thus, the extremum dimensions of such voids are presented in the higher percentiles. In addition, the magnification of the cross sections of the sheet tended to cause many of the larger voids to be clipped at the edges as the larger voids extended outside the viewing area. Thus, for additional information, the interior (unclipped) voids are characterized by extremum data and the edge (clipped) voids are characterized.

Void Area—Void area is a measure of the area within each void. The void area data is presented in a similar fashion as the void extremum data.

Textural Analysis of Bonded Sheet—Tyvek® sheet has a readily apparent irregular pattern therein due to the overlapping fibers and the non-uniform pattern in which the webs are laid. The non-uniformities can be easily seen visually on a light box where light is provided behind the Tyvek® sheet and there are lighter regions and darker regions. In these analytical tests, the uniformity of the sheet is quantitatively analyzed by segmenting the sample sheet into many small segments or pixels. A standard Hewlett Packard Deskscan II was used to digitize an image of the light passing through the sample and the pixel size has been measured as 169 $\mu$ by 169 $\mu$. It has been subsequently discovered since the data were collected and analysis performed that such equipment may be used for finer scale analysis.

Each pixel is then characterized by a gray level value based on the intensity of light received by the sensor at that pixel. A series of textural features can be calculated from the digitized image in order to quantitatively describe the texture of the sheet. Such a set of features has been created and described for a variety of data sources by Robert M. Haralick et al., in his paper published in the IEEE Transactions on Systems, Man and Cybernetics, Vol. SMC-3, No. 6, pp 610–621 dated 1973, and the paper is hereby incorporated by reference.

Figure 3:
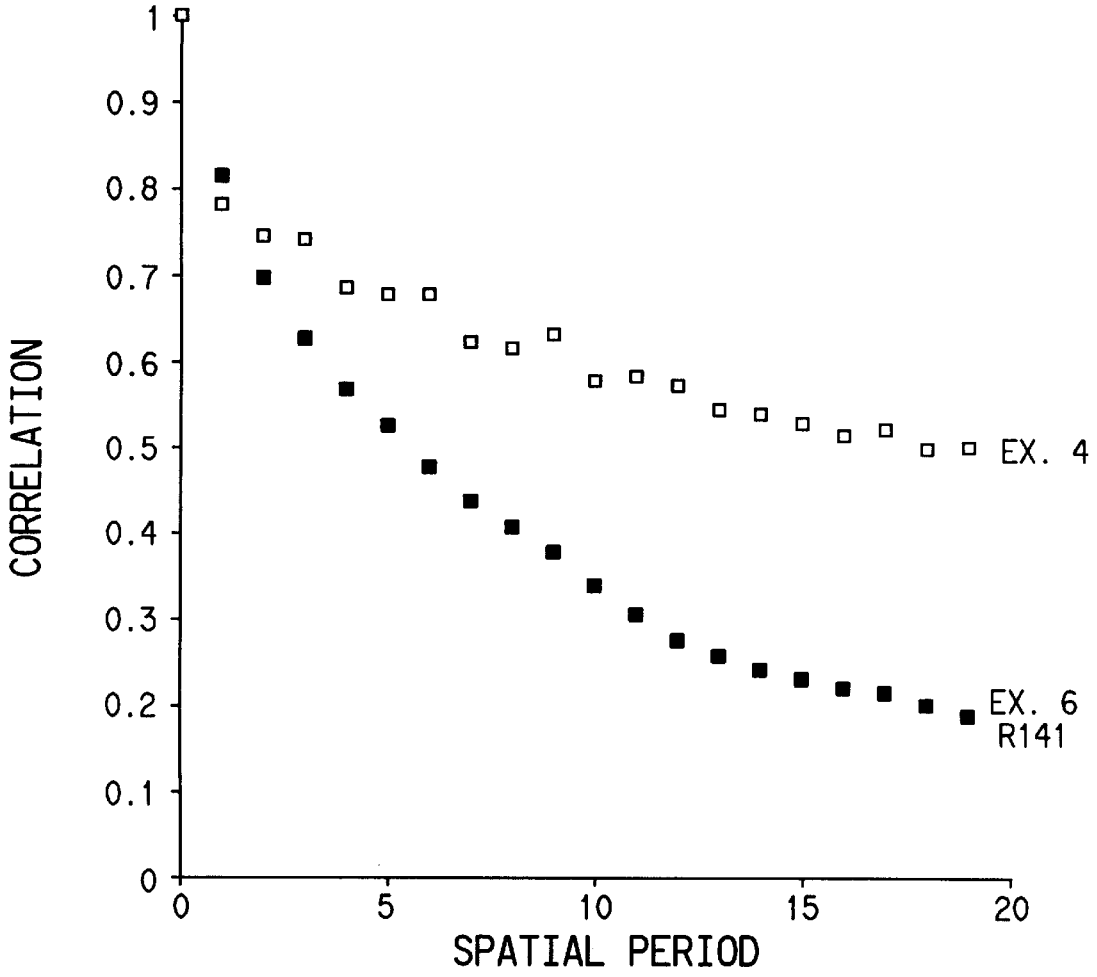
FIG. 3 is a graph showing a textural analysis of bonded sheet particularly showing the relationship of pixel light transmission correlation versus spatial period.

In FIG. 3 of the present invention, the Haralick Correlation feature (Haralick feature 3) is graphed relative to the spatial period of the pixels for the sheets of Examples A and B. The Haralick Correlation feature at a given spatial period is a statistical measure of the correlation in gray level values between pixels spaced apart by the selected period. It is normalized to have the value 1.0 when all pixels being compared have exactly the same gray level value.

Conversely, if the gray levels in an image are varying very rapidly (approaching a random distribution) over small distances, the correlation feature will decrease substantially at small values of the spatial period and asymptotically approach zero.

Figure 4:
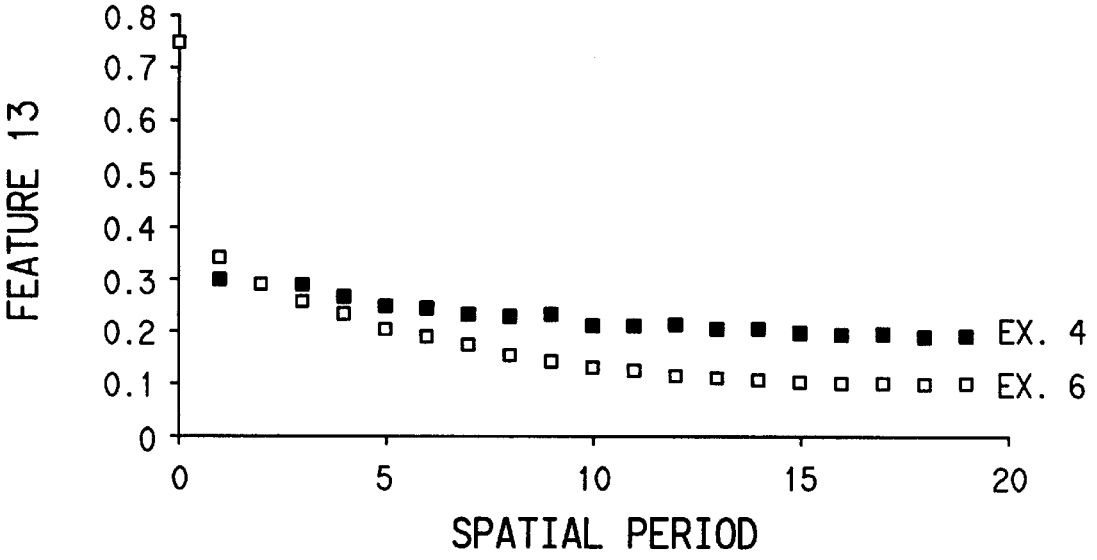
FIG. 4 is a graph showing a textural analysis of bonded sheet similar to that illustrated FIG. 3 but showing the information measure of correlation.

Another useful textural feature described by Haralick is the Haralick Information Measure of Correlation (Haralick feature 13) which is similar to the Haralick Correlation feature described above, but has the advantage that it is invariant under monotonic gray level transformations in contrast to the Haralick Correlation feature 3. FIG. 4 illustrates the relationship between the Haralick Information Measure of Correlation and spatial period for Examples A and B. While the comparison of Examples 4 and 6 by the technique illustrated in FIG. 3 is more clearly distinctive, Haralick points out that the comparison is somewhat dependent on the intensity of the light in the scanning equipment and is otherwise dependent of the equipment.

Referring primarily to the Haralick Correlation feature relative to the spatial period as shown in FIG. 3, the data confirms quantitatively what is seen visually in the sheet. That is that Sheet 4 material is more blotchy or has large blotchy areas. The Sheet 6 material has a more uniform appearance which is reflected in the analysis by a more quickly decreasing Correlation relative to spatial period. It may be theorized that Sheet 4 material has its appearance due to the presence of wider fibril bundles, larger open areas between fibers, longer tie points in the fiber and lower fibrillation of the web. Thus, pixels found within a bundle will have similar gray levels as will pixels in the thinner areas between such fiber bundles, resulting in higher levels of correlation over theses short distances. By contrast, in the Sheet 6 material, the finer fibril and better fibrillated web structure creates a more rapidly varying gray level intensity pattern resulting in lower correlation values over the short spatial periods of interest.

It is interesting to note that although the Example 4 product appears visually less uniform over larger length scales (much greater than 3.4 mm), it appears generally more uniform over short length scales (less than 3.4 mm.).

Measurements

The following are a general discussion of the more common testing procedures used by DuPont for collecting data for samples of web and sheet materials:

Surface Area

Surface area is calculated from the amount of nitrogen absorbed by a sample a liquid nitrogen temperatures by means of the Brunauer-Emmet-Teller equation and is given in $m^2/g$. The nitrogen absorption is determined using a Strohlein Surface Area Meter manufactured by Standard Instrumentation, Inc., Charleston, W. Va.

Tenacity of the Web and Elongation

The tensile properties of the plexifilamentary web or strand are determined using a constant rate of extension tensile testing machine such as an Instron table model tester. A six inch length sample is twisted and mounted in the clamps, set 2.0 in (5.08 cm) apart. The twist is applied under a 75 g load and varies with denier - 10 turns per inch (tpi) up to 360 denier, 9 tpi for 361–440 denier, 8 tpi for 441–570 denier, 7 tpi for 571–1059 denier, and 6 tpi at 1060 and above. A continuously increasing load is applied to the twisted strand at a crosshead speed of 2.0 in/min (5.08 cm/min) until failure. Tenacity is the break strength normalized for denier and is given as grams (force) per denier, g/denier (or dN/tex). Elongation is given as the percentage of stretch prior to failure.

Denier is determined by measuring and cutting a known length while under load—250 g for four doubled strands. The sample strands are weighed and the denier calculated. Denier is the weight in grams per 9000 meters of length. (Tex is the weight in grams per 1000 meters of length).

Sheet Tensile

Sheet tensile properties are measured in a strip tensile test. A 1.0 inch (2.54 cm) wide sample is mounted in the clamps—set 5.0 inches (12.7 cm) apart—of a constant rate of extension tensile testing machine such as an Instron table model tester. A continuously increasing load is applied to the sample at a crosshead speed of 2.0 in/min (5.08 cm/min) until failure. Tensile strength is the break strength normalized for sample weight, i.e. $(lbs/in)/(oz/yd^2)$. Elongation to break is given in percentage of stretch prior to failure. The test generally follows ASTM D1682-64.

Tear

Tear strength means Elmendorf tear strength and is a measure of the force required to propagate a tear cut in the fabric. The average force required to continue a tongue-type tear in a sheet is determined by measuring the work done in tearing it through a fixed distance. The tester consists of a sector-shaped pendulum carrying a clamp which is in alignment with a fixed clamp when the pendulum is in the raised starting position, with maximum potential energy. The specimen is fastened in the clamps and the tear is started by a slit cut in the specimen between the clamps. The pendulum is then released and the specimen is torn as the moving jaw moves away from the fixed jaw. Elmendorf tear strength is measured in accordance with TAPPI-T-414 om-88 and ASTM D 1424.

Delamination

Delamination of a sheet sample is measured using a constant rate of extension tensile testing machine such as an Instron table model tester. A 1.0 in (2.54 cm) by 8.0 in (20.32 cm) sample is delaminated approximately 1.25 in (3.18 cm) by inserting a pick into the cross-section of the sample to initiate a separation and delamination by hand. The delaminated sample faces are mounted in the clamps of the tester which are set 1.0 in (2.54 cm) apart. The tester is started and run at a cross-head speed of 5.0 in/min (5.08 cm/min). The computer starts picking up readings after the slack is removed in about 0.5 in of crosshead travel. The sample is delaminated for about 6 in (15.24 cm) during which 3000 readings are taken and averaged. The average delamination strength is given in lbs/in (kg/m). The test generally follows ASTM D 2724-87.

Opacity

One of the qualities of Tyvek® is that it is opaque and one cannot see through it. Opacity is the measure of how much light is reflected or the inverse of how much light is permitted to pass through a material. It is measured as a percentage of light reflected.

Gurley Hill Test Method

The Gurley Hill test method is a measure of the barrier strength of the sheet material for gaseous materials. In particular, it is a measure of how long it takes for a volume of gas to pass through an area of material wherein a certain pressure gradient exists.

Gurley-Hill porosity is measured in accordance with ASTM D-726-84 and TAPPI T-460 using a Lorentzen & Wettre Model 121D Densometer. This test measures the time of which 100 cubic centimeters of air is pushed through a one inch diameter sample under a pressure of approximately 4.9 inches of water. The result is expressed in seconds and is usually referred to as Gurley Seconds. ASTM refers to the American Society of Testing Materials and TAPPI refers to the Technical Association of the Pulp and Paper Industry.

Hydrostatic Head

The hydrostatic head tester measures the resistance of the sheet to penetration by liquid water under a static load. A 7×7 in (17.78×17.78 cm) sample is mounted in a SDL 18 Shirley Hydrostatic Head Tester (manufactured by Shirley Developments Limited, Stockport, England). Water is pumped into the piping above the sample at 60+/−3 cm/min until three areas of the sample is penetrated by the water. The measured hydrostatic pressure is given in inches of water. The test generally follows ASTM D 583 (withdrawn from publication November, 1976).

Turning now to the actual data and tests, six web and sheet samples were analyzed and the relevant data collected are presented in the following Table I. In addition, further data was collected for Examples 4 and 6 which are presented in Tables II and III. The example sheets and webs were made as follows:

Example 1 web and sheet is conventional Tyvek® made on one of the first manufacturing lines having 32 spin positions over a belt of ten feet in width. The spin agent is Freon 11 and the system was run at normal operating conditions. All of the sheets in all of the Examples were bonded using a Palmer bonder with saturated steam at 51 psi.;

Example 2 web and sheet is conventional Tyvek® made on the third manufacturing line having 64 spin positions. The spin agent is again Freon 11 and the system was run at normal operating conditions;

Example 3 web and sheet was made on the third manufacturing line using test polyethylene polymer which had exceptionally high density. The spin agent was Freon 11 and the system was run at normal operating conditions;

Example 4 web and sheet was made in the pilot plant for the new system. The pilot plant mixed 20% (by weight) polyethylene in n-pentane spin agent and passed it through the letdown chamber at 1500 pressure and 175° C. temperature with an average speed of fluid through the letdown chamber of approximately one foot per second. The spin cell was closed at a pressure of 3.55 inches (gage) of water and a temperature approximately 50 to 55° C. The sheets are approximately 28 inches wide, about 1.7 oz./sq. yd. and made with six separate webs or with six spin stations. Example 4 was made with a one half letdown chamber of 2.7 inches in length and a diameter of 0.615 inches.

Example 5 web and sheet was made in the pilot plant like Example 4, except with a two thirds letdown chamber having a length of 2.9 inches and a diameter of 0.615 inches;

Example 6 web and sheet was made in the pilot plant like Examples 4 and 5, except with a full size let down chamber of approximately 4.58 inches in length and 0.615 inches in diameter.

The description of this invention is intended only to disclose and describe the invention and the preferred embodiments thereof. It is not intended to limit the invention or scope of protection provided by any patent granted on this application.

TABLE I

| | Ex. 1 | Ex. 2 | Ex. 3 | Ex. 4 | Ex. 5 | Ex. 6 |
|---|---|---|---|---|---|---|
| Spin rate (pounds per hour per hole) | 170 | 110 | 110 | 50 | 50 | 50 |
| Mean Apparent Fibril Size ($\mu$) | 34.8 | 25.1 | 21.8 | 32.8 | 27.9 | 21.4 |
| Std. Dev. Size | 63 | 41 | 23 | 54.4 | 45.2 | 29.9 |
| Median Apparent Fibril Size ($\mu$) | 15.6 | 12.3 | — | 16.6 | 14.5 | 12.3 |

TABLE I-continued

| | Ex. 1 | Ex. 2 | Ex. 3 | Ex. 4 | Ex. 5 | Ex. 6 |
|---|---|---|---|---|---|---|
| Surface Area ($m^2$/gm) | 26 | 24–27 | — | 24–27 | 24–27 | 24–27 |
| Tenacity-Web (gm/denier) | 4.5 | 5.0 | — | 3.8 | 4.5 | 5.5 |
| Web Elongation (%) | 50 | — | — | 45 | 44 | 42 |
| Tensile Strength-Sheet ([lbs/in]/[oz/yd$^2$]) | 18.3 | 18.4 | 20.2 | 16–17.5 | 17–18.5 | 17–18.5 |
| Sheet Elongation (%) | 23.8 | 21.4 | — | 19 | 19 | 19–20 |
| Tear - Sheet (lbs) | 1.1 | 1.9 | — | 0.9 | 1.1 | 1.6–2.0 |
| Delamination (lbs/in) | 0.41 | 0.27 | — | 0.68 | 0.45–0.55 | 0.4–0.5 |
| Opacity (%) | 96.7 | 98.1 | — | 95 | 90–94 | 94 |
| Gurley Hill (sec) | 41 | 37.0 | 74 | ~200 | 60 | 16 |
| Hydro Head (in-$H_2O$) | 71.7 | 64.8 | — | 50–60 | 50–60 | 61 |

TABLE II

| | Example 4 | Example 6 |
|---|---|---|
| Fractional Area of Openings | 0.707 | 0.494 |
| Maximum Opening size ($\mu$) | 26402.3 | 8200.3 |
| Mean Opening Size ($\mu$) | 680.69 | 455.87 |
| Std. Dev. Size ($\mu$) | 1151.87 | 494.56 |
| Std. Dev. Perimeter | 3492.14 | 2503.87 |
| Mean Perimeter | 4040.98 | 2569.24 |
| Size Entropy | 0.9320 | 0.9738 |
| Perimeter Median ($\mu$) | 1755 | 1537 |
| Perimeter 75th percentile ($\mu$) | 3404 | 2631 |
| Perimeter 80th percentile ($\mu$) | 4169 | 3075 |
| Perimeter 90th percentile ($\mu$) | 7629 | 4927 |
| Perimeter 95th percentile ($\mu$) | 13414 | 7424 |
| Equiv. Circular Size Median ($\mu$) | 380 | 329 |
| Equiv. Circ. 75th Percentile ($\mu$) | 662 | 497 |
| Equiv. Circ. 80th Percentile ($\mu$) | 780 | 565 |
| Equiv. Circ. 90th Percentile ($\mu$) | 1301 | 803 |
| Equiv. Circ. 95th Percentile ($\mu$) | 2076 | 1113 |

TABLE III

| | Example 4 | Example 6 |
|---|---|---|
| Porosity (GH) | ~200 | 16 |
| Opacity | 95 | 94 |
| Void Fraction (%) | 27% | 38% |
| Mean Void Extremum | 5.04$\mu$ | 5.08$\mu$ |
| Median Void Extremum | 2.7$\mu$ | 2.6$\mu$ |
| 75th percentile Extremum | 5.5$\mu$ | 5.9$\mu$ |
| 80th percentile Extremum | 7.6$\mu$ | 7.6$\mu$ |
| 90th percentile Extremum | 12.1$\mu$ | 14.8$\mu$ |
| 95th percentile Extremum | 20.6$\mu$ | 28.5$\mu$ |
| Mean Void Area | 5.3$\mu^2$ | 7.0$\mu^2$ |
| Median Void Area | 1.8$\mu^2$ | 1.7$\mu^2$ |
| 75th percentile Void Area | 5.2$\mu^2$ | 5.3$\mu^2$ |
| 80th percentile Void Area | 7.2$\mu^2$ | 7.7$\mu^2$ |
| 90th percentile Void Area | 18.5$\mu^2$ | 24.2$\mu^2$ |
| 95th percentile Void Area | 44.2$\mu^2$ | 70.5$\mu^2$ |
| Interior Void Area Mean | 4.0$\mu^2$ | 3.7$\mu^2$ |
| Interior Void Extremum Mean | 5.0$\mu$ | 5.1$\mu$ |
| Edge Void Area Mean | 28.5$\mu^2$ | 58.5$\mu^2$ |
| Edge Void Extremum Mean | 16.7$\mu$ | 24.7$\mu$ |

We claim:

1. A sheet product made from polymeric man-made flashspun fiber having an opacity greater than 80 percent and a Gurley Hill Porosity Value of greater than 120 seconds.

2. The sheet product according to claim 1 wherein the product has a basis weight of less than 2.5 oz./sq. yd.

3. The sheet product according to claim 1 wherein the product has a basis weight of less than 1.7 oz./sq. yd.

4. The sheet product according to claim 1 wherein the polymeric man-made fiber is plexifilamentary film-fibril web which is formed into a nonwoven sheet and fully bonded.

5. A fully bonded sheet product made of polymeric man-made flashspun fiber and having a basis weight of at least 1.4 oz./sq. yd. and a Gurley Hill Porosity Value of less than 20.

6. The fully bonded sheet product according to claim 5 wherein the polymeric man-made fiber is plexifilamentary film-fibril web which is formed into a nonwoven sheet.

7. A fully bonded sheet product made of polymeric man-made flashspun fiber having voids in the cross section comprising less than forty percent (40%) of the cross sectional area of the sheet and wherein no more than five percent of the voids have extremum lengths greater than 27 microns.

8. A fully bonded sheet product made of polymeric man-made flashspun fiber having voids in the cross section comprising at least thirty percent (30%) of the cross sectional area of the sheet and wherein at least five percent of the voids have extremum lengths greater than 23 microns.

9. A fully bonded sheet product made of polymeric man-made flashspun fiber and wherein the sheet product, so formed, has an irregular pattern of greater and lesser light transmissive areas, wherein textural analysis of the sheet product done by directing light through a sample of the sheet product and digitizing the transmitted light image using a Hewlett Packard Deskscan II scanner under standard operating conditions into pixels of approximately 169 square microns, and wherein each pixel is categorized as a light pixel or a dark pixel based on an objective light intensity basis, and such that the sheet product has a correlation relative to spatial period being in the range of 0.4 to 0.8 at a 15 pixel spatial period, 0.45 to 0.85 at a 10 pixel spatial period and between 0.3 and 0.8 at a 20 pixel spatial period.

10. A fully bonded sheet product made of polymeric man-made flashspun fiber and wherein the sheet product, so formed, has an irregular pattern of greater and lesser light transmissive areas, wherein textural analysis of the sheet product done by directing light through a sample of the sheet product and digitizing the transmitted light image using a Hewlett Packard Deskscan II scanner under standard operating conditions into pixels of approximately 169 square microns, and wherein each pixel is categorized as a light pixel or a dark pixel based on an objective light intensity basis, and such that the sheet product has a correlation based on the spatial period being in the range of 0.1 to 0.5 at a 15 pixel spatial period, 0.15 to 0.55 at a 10 pixel spatial period and between 0.05 and 0.45 at a 20 pixel spatial period.

11. A fully bonded sheet product made of polymeric man-made flashspun fiber and wherein the sheet product, so formed, has an irregular pattern of greater and lesser light transmissive areas, wherein textural analysis of the sheet product done by directing light through a sample of the sheet product and digitizing the light image into pixels of approximately 169 square microns, and wherein each pixel is categorized as a light pixel or a dark pixel based on an objective light intensity basis, and such that the sheet product has a Haralick feature 13 Information Measure of Correlation in the range of 0.19 to 0.35 at a 10 pixel spatial period, 0.15 to 0.325 at a 15 pixel spatial period, and between 0.125 and 0.3 at a 19 pixel spatial period.

12. A fully bonded sheet product made of polymeric man-made flashspun fiber and wherein the sheet product, so formed, has an irregular pattern of greater and lesser light transmissive areas, wherein textural analysis of the sheet product done by directing light through a sample of the sheet product and digitizing the light image into pixels of approximately 169 square microns, and wherein each pixel is categorized as a light pixel or a dark pixel based on an objective light intensity basis, and such that the sheet product has a Haralick feature 13 Information Measure of Correlation in the range of 0.075 to 0.2 at a 10 pixel spatial period, 0.05 to 0.175 at a 15 pixel spatial period, and between 0.05 and 0.175 at a 19 pixel spatial period.

13. A nonwoven sheet product made of overlapping layers of flashspun fibers bonded together with at least heat and pressure, wherein the web comprises fibrils having a mean apparent fiber width of greater than 24 microns, a median apparent fiber width of greater than about 13.5 microns, such that the fibers are spun from one or more orifices at less than 100 pounds per hour per orifice, and wherein the sheet product has a Gurley Hill Porosity Value of greater than 30 seconds.

14. A nonwoven sheet product made of overlapping layers of flashspun fibers bonded together with at least heat and pressure, wherein the web comprises fibrils having a mean apparent fiber width of less than 25 microns, a median apparent fiber width of less than about 13.5 microns, such that the fibers are spun from one or more orifices at less than 100 pounds per hour per orifice, and wherein the sheet product has a Gurley Hill Porosity Value of less than 20 seconds.

15. A nonwoven sheet product made of a plurality of overlapping flashspun plexifilamentary film-fibril webs wherein the webs have openings between the fibrils and the openings have an average perimeter of at least 2650 microns, the sheet includes portions which have at least four separate overlapping web swaths and the Gurley Hill Porosity Value is at least 25 seconds.

16. A nonwoven sheet product made of a plurality of overlapping flashspun plexifilamentary film-fibril webs wherein the webs have openings between the fibrils and the openings have an average perimeter of less than 3300 microns, the sheet includes portions which have at least four separate overlapping web swaths and the Gurley Hill Porosity Value is less than 75 seconds.

17. A nonwoven sheet product made from a plurality of overlapping flashspun plexifilamentary film-fibril webs, wherein the sheet product has a cross section comprising fibrils which are bonded together and form voids within the sheet, the voids forming less than forty percent (40%) of the cross sectional area of the sheet and wherein the voids have a general shape so as to appear long and thin and wherein no more than five percent of the voids have extremum lengths greater than 27 microns.

18. The nonwoven sheet product according to claim 17 wherein the sheet product has an opacity of greater than 80.

19. The nonwoven sheet product according to claim 18 wherein the Gurley Hill Porosity Value is greater than 80.

20. The nonwoven sheet product according to claim 17 wherein less than fifteen percent of the voids have extremums greater than four microns.

* * * * *